United States Patent [19]

Miller

[11] 4,262,601

[45] Apr. 21, 1981

[54] CAM ACTUATED RAILWAY HOPPER CAR LOCK MECHANISM

[75] Inventor: Roy W. Miller, Highland, Ind.

[73] Assignee: Pullman Incorporated, Chicago, Ill.

[21] Appl. No.: 27,684

[22] Filed: Apr. 6, 1979

[51] Int. Cl.[3] ..... B61D 7/06; B61D 7/18; B61D 7/26; B61D 7/30

[52] U.S. Cl. ..... 105/241.2; 105/251; 105/290; 105/308 R; 414/388

[58] Field of Search ..... 105/240, 241 R, 241 C, 105/250, 251, 252, 308 R, 241.2, 308, 290; 414/387, 388

[56] References Cited

U.S. PATENT DOCUMENTS

| | | | |
|---|---|---|---|
| 975,860 | 11/1910 | Harrigan | 105/251 |
| 3,316,858 | 5/1967 | Fritz | 105/251 X |
| 3,783,797 | 1/1974 | Shaver | 103/251 |
| 3,800,711 | 4/1974 | Tuttle | 105/251 |
| 3,805,708 | 4/1974 | Schuller et al. | 105/251 |
| 3,872,796 | 3/1975 | Adler et al. | 105/308 R X |
| 3,949,681 | 4/1976 | Miller | 105/250 X |
| 4,138,948 | 2/1979 | Korolis | 105/252 X |
| 4,181,336 | 1/1980 | Miller | 105/251 X |

*Primary Examiner*—Howard Beltran
*Attorney, Agent, or Firm*—Stephen D. Geimer

[57] ABSTRACT

An arrangement for operating longitudinally disposed discharge door for a railway hopper vehicle includes adjacent pairs of interconnected hopper doors. The doors of each pair are connected by linkages to provide simultaneous, cooperative opening and closing movement. The inner door of each pair is operatively connected with a locking linkage which, when in the locked position, engages a longitudinally displaceable locking cam to secure the doors. Displacement of the locking cam permits the weight of the lading within the car to open the discharge doors. The doors are returned to the closed position by means of door-engaging trackside cams, and the locking cam is returned to the locked position securing the doors.

14 Claims, 11 Drawing Figures

2
2
4
4
8
9
11
3
10
5
3
3
1

8
68'
68
69
71
11
7
7
10
9
3
3
9
7
7
11
7
67'
67
70
8
73
73

9
9
11
11
13
14
15
16
17
18
19
22
23
24
25
26
27
30
31
33
34
39
74

CAM ACTUATED RAILWAY HOPPER CAR LOCK MECHANISM

BACKGROUND OF THE INVENTION

1. Field of the Invention

This invention relates to vehicles such as railway hopper cars and in particular to bottom door mechanisms for discharging material from such vehicles.

2. Description of the Prior Art

The prior art discloses a variety of bottom door mechanisms for hopper cars. However, the prior art is generally characterized by one or more deficiences such as failure to provide positive locking of the doors, being excessively complex and expensive to fabricate, being difficult to maintain and repair, and being susceptable to inadvertant opening due to the load on the door during rail operations.

SUMMARY OF THE INVENTION

The present invention contemplates an operating arrangement for adjacent pairs of longitudinally disposed hopper discharge doors on a railway vehicle. The doors of each pair are operatively interconnected in order to provide simultaneous, cooperative opening and closing movement. The inner door of each pair is operatively interconnected with a transversely disposed locking arm which, when in the locked position, engages a longitudinally displaceable locking cam carried beneath the center sill of the car. Displacement of the locking cam is accomplished by a trackside tripping bail or other suitable means, whereupon the discharge doors are free to open under the weight of the lading within the hopper. When discharge of the lading is complete, each pair of doors is returned to the closed position by engagement of rollers mounted on each of the outer doors with suitable trackside closing cams, whereupn the locking cam is returned to the locked position thereby securing the doors.

DESCRIPTION OF THE PREFERRED EMBODIMENT

Figure 1:
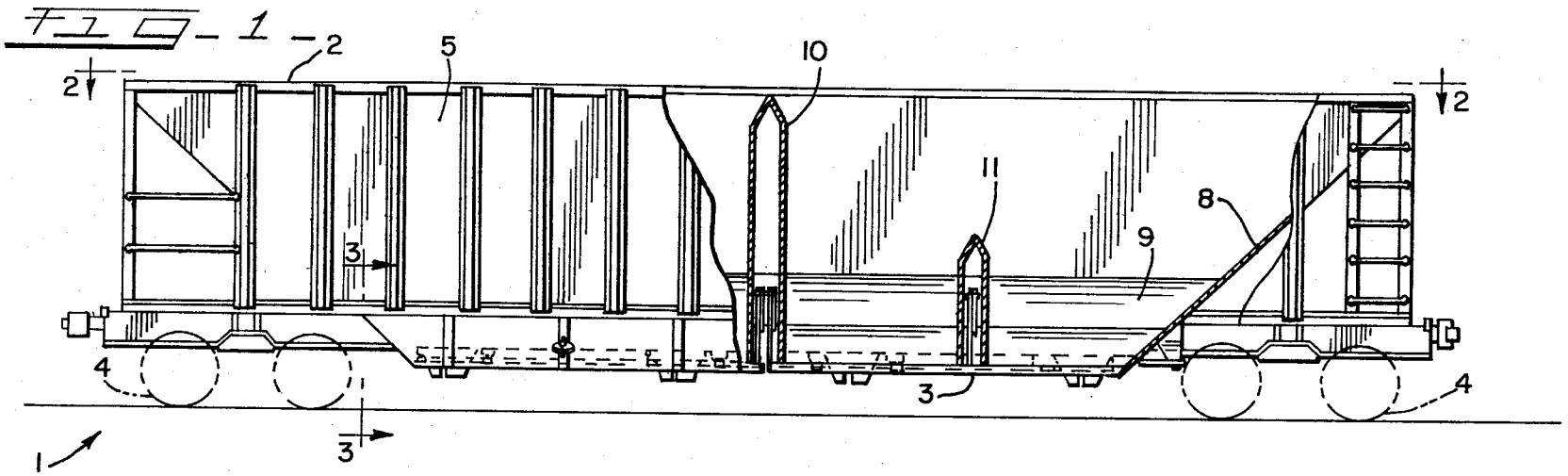
FIG. 1 is a side elevational view, partially in section, showing a railway hopper car including the door mechanism embodying the present invention.
Figure 2:
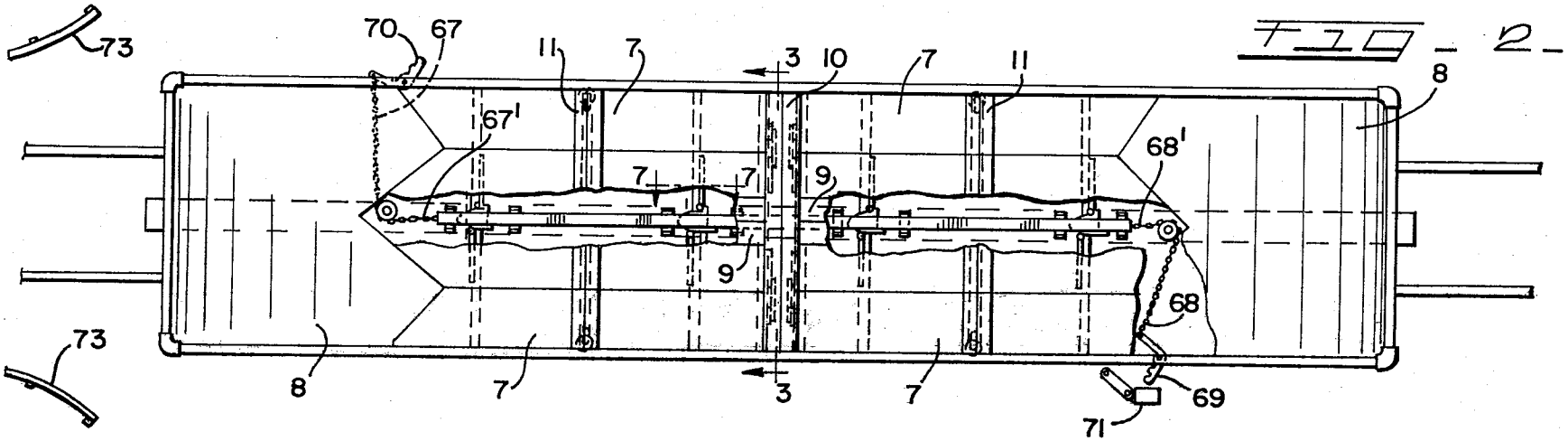
FIG. 2 is a plan view, partially in section, of the hopper car shown in FIG. 1.

A railway hopper car 1, as shown in FIGS. 1 and 2, includes a car body 2 having an underframe structure 3 supported on car trucks 4. The car body includes side walls 5 projecting upwardly and connected to conventional side sills 6. The car 1 includes hopper structures 7 including end walls or sheets 8 and inner longitudinally extending sloping walls 9 and a transversely extending hood or shroud 10 and intermediate hoods 11. The car structure thus provides a total of four hoppers 7, longitudinally spaced pairs being disposed on opposite sides of the car center sill 12 and each of the hoppers having a pair of doors including an inner door 13 and an outer door 14, both being of an essentially welded construction.

Figures 8, 9, 10, 11:
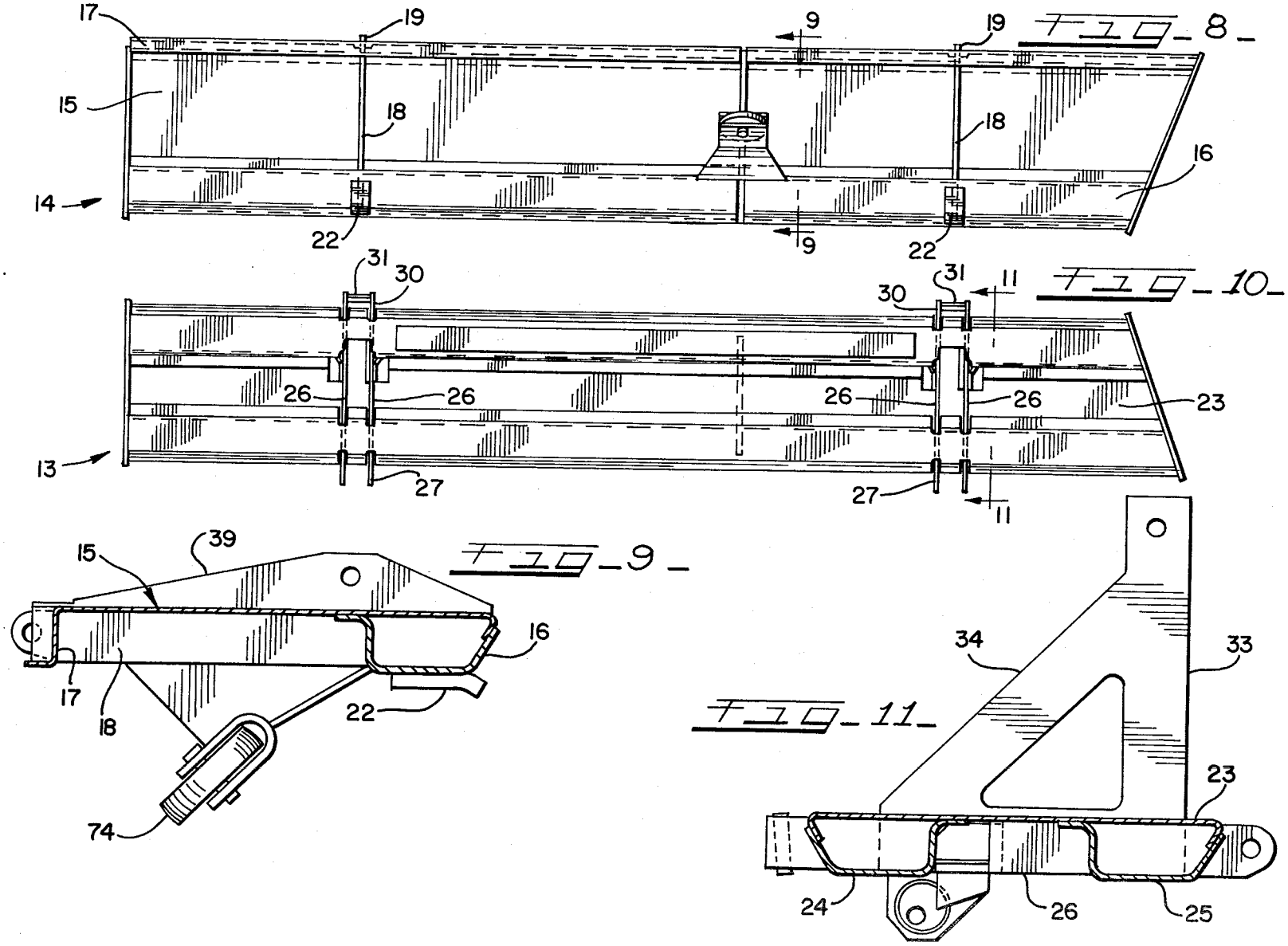
FIG. 8 is a bottom view of one of the outer doors shown removed from the hopper car of FIG. 1.
FIG. 9 is a cross-sectional view taken substantially along line 9—9 in FIG. 8.
FIG. 10 is a bottom view of the inner door cooperative with the outer door shown in FIG. 8 shown removed from the hopper car of FIG. 1.
FIG. 11 is a cross-sectional view taken substantially along line 11—11 in FIG. 10.

As shown in FIG. 9, the outer doors 14 each include a longitudinal plate 15 welded or otherwise appropriately secured to a longitudinally extending channel or beam 16 at its inner edge and including a longitudinally extending rigidifying flange portion 17 at its outer edge. As shown in FIGS. 3, 5, 8 and 9, each outer door 14 includes a pair of longitudinally spaced transverse stiffener plates 18 including outer hinge bracket portions 19 extending outwardly from the door and hingedly connected by pins 20 to hinge ears 21 supported from the lower side sill 6 of the car and a pair of longitudinally spaced locking fingers 22 projecting from the inner edge of the doors 14 as shown in the drawings.

Figure 3:
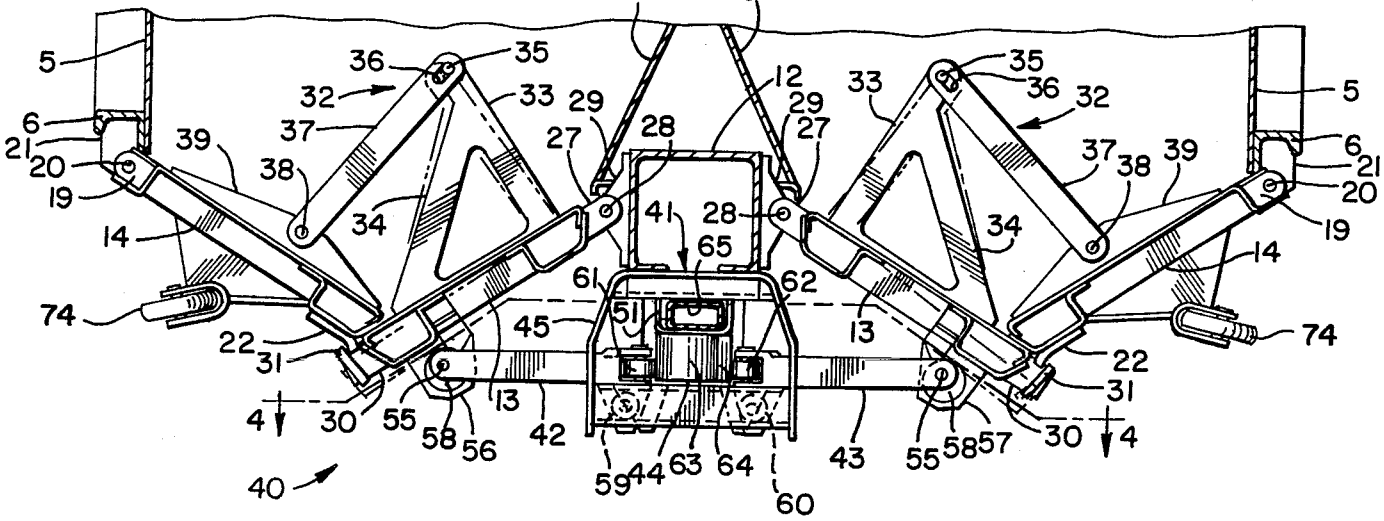
FIG. 3 is a cross-sectional elevational view taken substantially along line 3—3 of FIG. 2.
Figures 5, 6, 7:
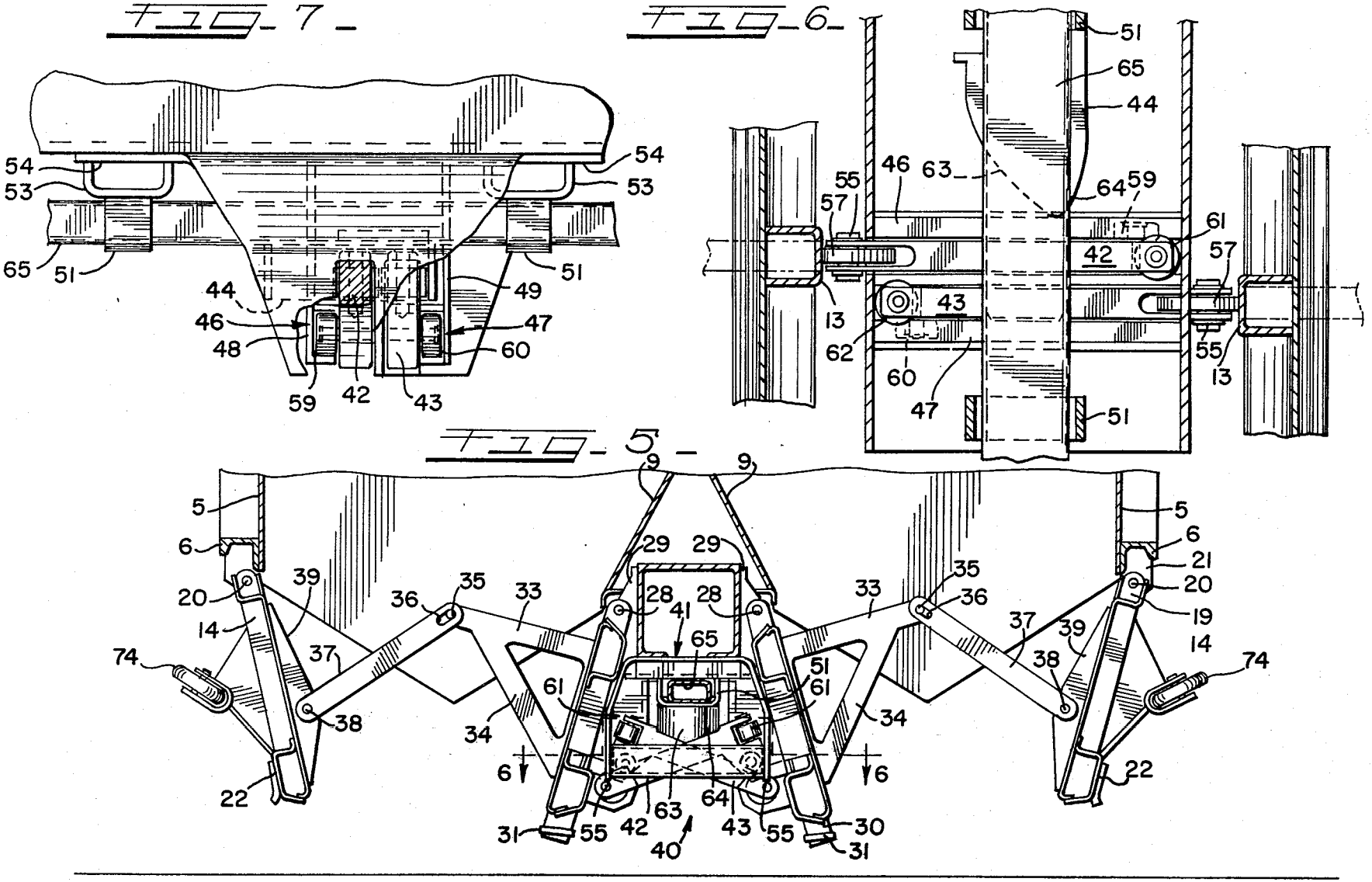
FIG. 5 is a view similar to FIG. 3 showing the car doors in the open position.
FIG. 6 is a view similar to FIG. 4 showing the door mechanism in the open, unlocked position, partially in section, taken substantially along line 6—6 in FIG. 5.
FIG. 7 is a side elevational view, partially in section, taken substantially along line 7—7 in FIG. 4.

As shown in FIGS. 10, 11, the inner doors 13 each include a plate 23 appropriately secured to a pair of transversely spaced longitudinally extending channels or beams 24, 25. Each door includes two pairs of longitudinally spaced transverse stiffeners or plates 26. As shown in FIGS. 3, and 5 each pair of plates 26 includes a clevis or bracket portion 27 extending from the inner edge of the door 13 which is pivotally connected by hinge pin 28 to hinge ears 29 suitably supported on the center sill 12, and, at the outer edge of the door, projecting locking portions 30 having a lock bar 31 extending therebetween and engagable by a respective locking finger 22 as hereinafter disclosed.

As shown in FIGS. 2 and 3, the central ends and intermediate portions of each pair of doors 13, 14 are operatively interconnected by a pair of lost-motion linkages 32. Each linkage 32 includes a rigid pivot arm 33 extending vertically from plate 23 of the inner door 13 and reinforced by a diagonal brace 34. The upper end of each pivot arm 33 is pivotally connected by means of a lost-motion pin 35 and slot 36 connection to a link arm 37 pivotally connected by the pin 38 and bracket 39 to the outer door 14.

As noted above, and shown in FIGS. 3 and 5 each pair of adjacent hoppers 7 include two door locking mechanisms 40 which lock and also support the doors in the closed and locked positions. Each mechanism 40 is located inward from a respective end of an associated door pair and directly supports the opposing inner doors 13 on each side of the center sill 12. The outer doors 14 are in turn supported by the inner doors 13 as will be described such that upon release of the door locking mechanisms 40, both pairs of doors will open simultaneously to permit the discharge of lading within the car.

Each mechanism 40 includes a center frame 41 supporting locking arms 42, 43 which are operatively interactive with a locking or blocking cam 44 supported within the frame 41 and longitudinally reciprocable to lock or unlock the mechanism as desired. Each center frame 41 is of a welded or similar construction and includes an outer shell 45 connected and depending from the center sill 12, a pair of transverse interior guide channels 46, 47, vertical transverse divider plates 48, 49, and tube guide channels 51 depending from guide brackets 53 connected to the upper plate portion 54 of the frame shell 45. The locking arm 42, 43 are pivotally connected to the inner doors 13 by pins 55 coupling the outer ends of the arms 42, 43 to adjustable hinge brackets 56, 57 suitably connected to each door 13. It should be noted that each hinge bracket 56, 57 includes a rotatable plug 58 of conventional construction in which the pin 55 is eccentrically mounted such that upon assembly of the mechanism the plug 58 can be rotated and secured in position by welding or the like, thus accommodating adjustment of the mechanism. The inner ends of the arms 42, 43 are provided with longitudinal rollers 59, 60 which are connected and carried within the guide channels 46, 47 respectively, and also vertical rollers 61, 62 which are engageable against the respective camming surfaces 63, 64 of the locking cam 44 in the locked position and carried there against as the cam is moved longitudinally to the unlocked position.

Figure 4:
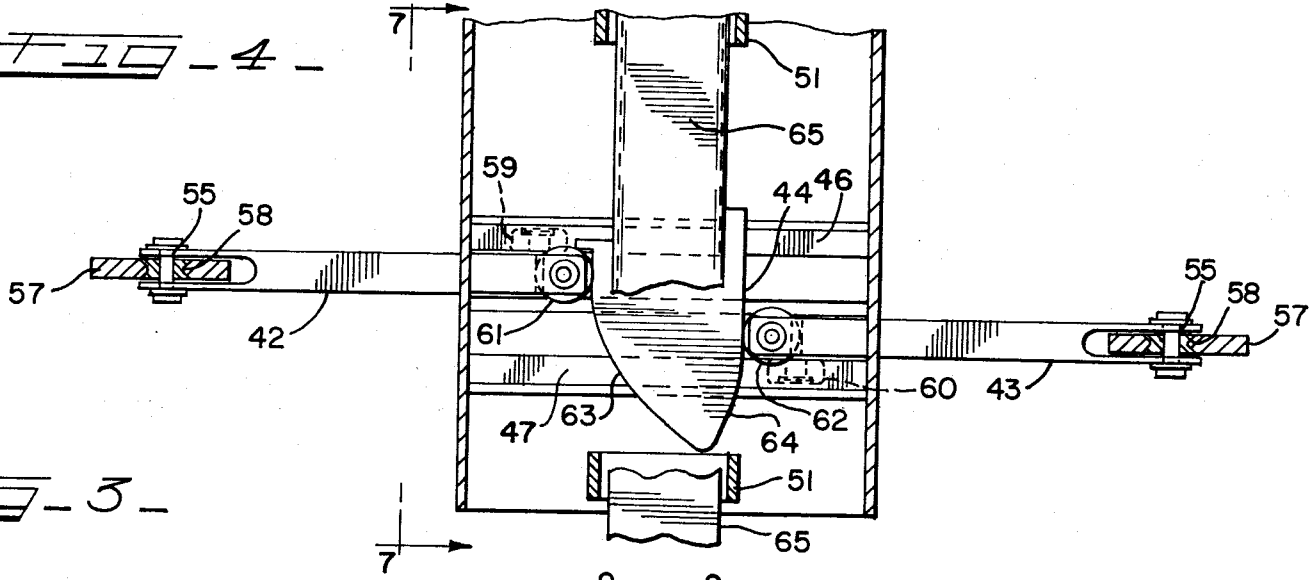
FIG. 4 is a plan cross-sectional view, partially in section, taken substantially along line 4—4 in FIG. 3.

As shown in FIG. 4, the cam 44 is of a generally longitudinally offset wedge or tapered configuration defined by the vertical camming surfaces 63, 64. The cam 44 is carried upon and depends from the longitudinally extending actuating tube or bar 65 slidably carried within the tube guide channels 51. In the preferred embodiment a single tube is provided to carry all four of the cams 44 to assure simultaneous locking and unlocking of all the locking mechanisms in the car. However, substantially simultaneous operation of the mechanisms can be obtained with a separate tube in each mechanism provided they are interconnected by cables, chains, or other tension members.

To longitudinally reciprocate the tube 65 and thus move it between the locked and unlocked positions, a chain-type linkage is connected to the ends of the tube 65. The chain linkage includes chains or cables 67, 68 connected at 67', 68' to the respective ends of the tube 65, and associated bell cranks 69, 70 mounted on diagonally opposite sides of the car and engageable by trackside bails 71, 72 which rotate the cranks 69, 70 to selectively longitudinally shift the cams 44 between their respective locked and unlocked positions. Of course, a car mounted fluid cylinder or the like would also be suitable to shift the tube 65 so as to operate the locking mechanisms.

OPERATION

As the loaded coal car enters the dumping site, the trackside bail or hook 71 engages the crank 69 on the side of the car. The crank 69 is rotated by the bail 71 upon continued movement of the car and, in turn, draws the chain 68 and thus the tube 65 toward its unlocked position (i.e., the tube 65 is moved toward the right as shown in FIG. 2). This movement withdraws the cam 44 from between the vertical rollers 61, 62 on the locking arms 42, 43 and thus the weight of the coal acting on the doors in turn pushes the inner ends of the locking arms 42, 43, carried upon the rollers 59, 60 captive within the guide channels 46, 47 across the frame 41 to the open, unlocked position as shown in FIG. 5.

As the car leaves the dumping site, converging trackside camming rails 73 disposed on each side of the track are engaged by rollers or cam followers 74 projecting from each outer door and thus the doors 13, 14 are in turn carried into the closed position as shown in FIG. 3. More specifically, as each outer door 14 is urged inward by the camming rail 73, the linkage 32 connecting the inner and outer doors 13, 14 lifts the inner door 13. It should be particularly noted that during the door closing operation the inner door is initially lifted to a point just below its closed position by means of the lost-motion pin 35 and slot 36 connection. Thereafter, and while the outer doors 14 are held in the closed position by the trackside camming rails 73, the bail 72 engages the crank 70 which in turn draws the chain 67 and tube 65 so as to return the blocking cam 44 to the locked position. This movement, accommodated by the lost-motion connection of the linkages 32, urges the inner door outward toward its ultimate closed position whereupon the locking fingers 22 are engaged upon the lock bars 31 to provide an anti-creep lock securing the inner and outer doors in the closed position.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

I claim:

1. A railway hopper car including a longitudinally extending hopper structure having a bottom discharge opening; including first and second doors hingedly connected to the hopper for swinging movement of the doors between respective closed and opened positions, linkage means interconnecting said doors for conjoint movement, locking means for securing the doors in the closed position, comprising:

a locking cam slidably mounted on said hopper structure for movement between respective door locked and unlocked positions, a locking member having an outer portion connected to said inner door, and an inner portion including a cam follower engaging the cam in the door locked position, door positioning means for disposing the locking member with respect to the locking cam concurrect with moving the hopper door to the closed door position to permit the locking cam to hold the locking member in the door closed position, and actuating means operatively connected with said cam for reciprocable movement of said locking cam along the hopper structure between respective locked and unlocked positions, said locking member, upon movement of the cam to the locked position, engaging said cam to secure the doors in the closed position, and upon movement of the cam toward unlocked position, the locking member disengaging said cam thereby permitting said doors to move to the opened position.

2. The invention in accordance with claim 1, including interlocking means mounted on said first and second doors being interengageable in the closed position thereof.

3. The invention according to claim 2, and said interlocking means including first projecting means on said first door extending outwardly with respect to the edge portion of said first door and second projecting means on said second door extending outwardly from another edge portion of said second door and into overlapping engagement with said first porjecting means when said doors are in the closed position.

4. The invention according to claim 1, said hopper car having a second hopper structure also having first and second doors and said locking cam being disposed between said hopper structures and including first and second camming portions engageable by the cam followers of respective locking members operatively associated with each of said first doors.

5. The invention in accordance with claim 4, and each of said locking members of said hopper structure being opposed to the other and moveable transverse to the length of the car and overlapping one another when said cam is moved to the door unlocked position, the weight of each of said door sets causing movement of each of said locking arms toward and overlapping one another.

6. The invention in accordance with claim 5 and guide means for carrying each locking member in a fixed linear path toward and away from one another and the cam.

7. The invention according to claim 1, and said actuating means including a longitudinally extending horizontal member movably supported on said car adjacent said hopper structure, and said locking cam being supported on said horizontal member.

8. The invention in accordance with claim 1, wherein said linkage means interconnecting said doors a lost-motion connection for sequential operation of said doors.

9. The invention in accordance with claim 1, wherein said door positioning means including door mounted cam follower means adapted to engage with an associated trackside mounted cam for moving said doors to the closed position.

10. The invention in accordance with claim 1, said cam follower comprising a roller mounted on said arm for rolling movement about a vertical axis.

11. The invention in accordance with claim 1, said locking member being pivotably connected with said first door, and said locking member including roller means engageable with said hopper structure for guiding said locking member between cam engaging and cam disengaging positions.

12. The invention in accordance with claim 1, said locking cam having camming portions on the sides thereof, converging at the off-center line point of the cam.

13. The invention in accordance with claim 1, and a longitudinally extending bar beneath the center sill carrying said cam and said cam being rollably engageable with said locking member for maintaining the doors in a closed position.

14. The invention in accordance with claim 1, wherein said actuating means comprising:

a bar slidably movable within said hopper structure and connected to said locking cam, link means connected to said bar, and triggering means for precipitation of pulling movement of said link means connected thereto.

* * * * *